United States Patent [19]

Hattori

[11] 4,370,926

[45] Feb. 1, 1983

[54] PRINTING PRESS FOR PRINTING SHEETS OF CORRUGATED PAPERBOARD

[75] Inventor: Fukutaro Hattori, Kasugai, Japan

[73] Assignee: Isowa Industry Co., Ltd., Nagoya, Japan

[21] Appl. No.: 229,997

[22] Filed: Jan. 30, 1981

[30] Foreign Application Priority Data

Feb. 2, 1980 [JP] Japan ..... 55-11701

[51] Int. Cl.[3] ..... B41F 1/46; B41F 31/06

[52] U.S. Cl. ..... 101/207; 101/183; 101/209; 101/352

[58] Field of Search ..... 101/206, 207, 208, 209, 101/210, 350, 351, 352, 175, 176, 183

[56] References Cited

U.S. PATENT DOCUMENTS

| | | | |
|---|---|---|---|
| 993,495 | 5/1911 | Bates | 101/206 X |
| 1,025,258 | 5/1912 | Firm | 101/207 X |
| 1,982,830 | 12/1934 | Richter | 101/207 X |
| 3,500,745 | 3/1970 | Neal | 101/207 |
| 4,150,621 | 4/1979 | Raible | 101/209 X |

*Primary Examiner*—Edgar S. Burr
*Assistant Examiner*—Moshe I. Cohen
*Attorney, Agent, or Firm*—Fleit & Jacobson

[57] ABSTRACT

In a printing press, at least two inking arrangements are disposed relative to a plate cylinder so that one of the inking arrangements is moved toward the plate cylinder for application of ink onto the plate cylinder while the other is in a rest position.

4 Claims, 4 Drawing Figures

PRINTING PRESS FOR PRINTING SHEETS OF CORRUGATED PAPERBOARD

This invention relates to a printing press for printing sheets of corrugated paperboard and particularly, to such a printing press capable of quickly making a color change of printing ink.

A conventional printing press comprises a single inking arrangement disposed adjacent a plate cylinder having a plate mounted thereon, the inking arrangement including an ink fountain containing ink, an ink fountain roller and a form roller for applying the ink from the ink fountain through the ink fountain roller onto the plate on the plate cylinder to print the sheets of corrugated paperboard which are passed between the plate cylinder and a cooperating press cylinder. With this arrangement, when it is desired to change from one color ink to another, operation of the printing press must be stopped and subsequently, the inking arrangement is moved away from the plate cylinder for cleaning. Preparations for subsequent operation of the printing press will be made by filling the ink fountain with different color ink and resetting the inking arrangement relative to the plate cylinder after cleaning of the inking arrangement.

It will be noted from the foregoing that a considerable time is spent between color changes and in case of the small number of sheets to be printed, particularly, the time of stoppage of the press required to change the color of the ink may become longer than actual printing time. This problem will be also raised on a plurality of printing units for performing multicolor printing.

A main object of the present invention is to provide a printing press eliminating the disadvantage set forth above.

This object is achieved by providing a printing press wherein at least two inking arrangements are disposed relative to a plate cylinder so that one of the inking arrangements is moved toward the plate cylinder to an applying position where a form roller is brought into contact with the plate cylinder while the other is in a rest position where the form roller is in non-contact with the plate cylinder by moving the one inking arrangement away from the plate cylinder. With this arrangement, a color change from one color ink to another can be rapidly made without any need for stopping of the operation of the printing press.

The invention will now be described, by way of example only, reference being made to the drawings in which:

FIG. 3 is a sectional front view of the inking arrangement taken along line III—III in FIG. 2; and FIG. 4 is a schematic representation of a modification according to the invention.

Figure 1:
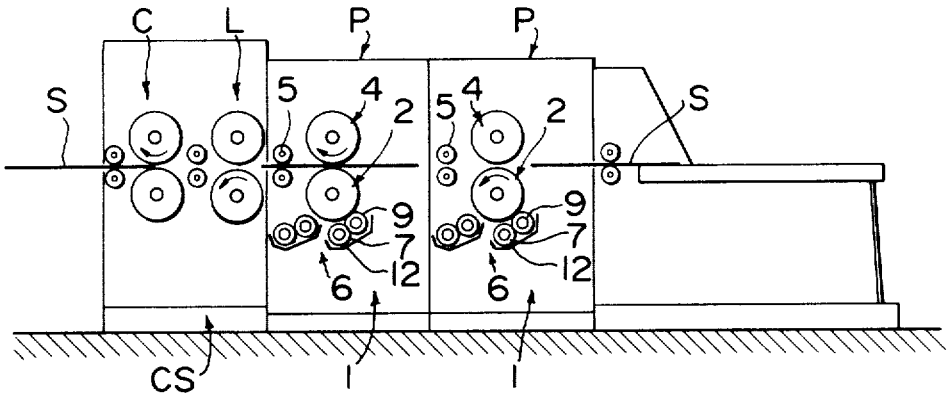
FIG. 1 is a schematic representation of a printing press such as a printer slotter embodying in accordance with the invention.

Referring to the drawings, there is shown in FIG. 1 a printing press comprises a creaser and slotter unit CS including a creaser L and a slotter C, and two printing units P and P disposed upstream the unit CS side by side for multicolor printing. Sheets to be printed may be of corrugated paperboard used for manufacture of box blanks.

Figure 2:
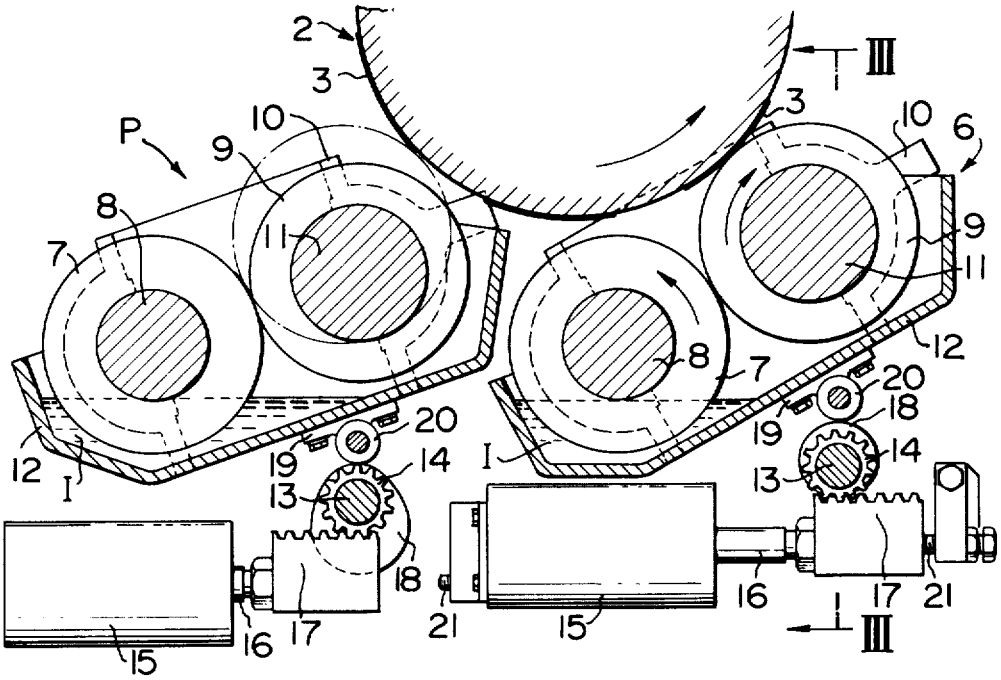
FIG. 2 is an enlarged side view of inking arrangements in one of the printing units shown in FIG. 1.

As can be best seen in FIGS. 2 and 3, each of the printing units P comprises conventional frames 1, a plate cylinder 2 mounted on the frames 1 for rotation and having a plate 3 interchangeably secured to the plate cylinder around its periphery, a pressing cylinder 4 on the frames capable of adjusting a spacing from the plate cylinder 2 to set a printing pressure on sheets of corrugated paperboard being printed, and feed rollers 5 mounted on the frames along a feed line of the sheets. The printing unit P also includes two inking arrangements 6 disposed relative to the plate cylinder 2 as described above.

In a preferred embodiment, each of the inking arrangements 6 includes an ink fountain 12 containing an amount of ink I, and ink fountain roller 7 partially immersed in the ink and a form roller 9 which is in contact with the ink fountain roller 7 and selectively brought into contact with the plate cylinder 2 to apply the ink onto the plate 3. The ink fountain roller 7 is fixedly mounted on a driving shaft 8 journaled in the frames 1 and connected to any suitable driving means (not shown). A pair of movable holders 10 and 10 are movably mounted on the driving shaft 8 at its ends to swing about an axis of the shaft 8 and provided with a shaft 11 rotatably supported in the movable holders, on which the form roller 9 is fixedly mounted. The ink fountain 12 extends between and is detachably secured between and to the movable holders 10.

There is provided means for swinging each inking arrangement 6 about the axis of the driving shaft 8 to move toward and away from the plate cylinder 2. An operating shaft 13 is rotatably supported in the frames 1 below the inking arrangement 6. A toothed pinion 14 is secured to the operating shaft 13 at its outer end to engage a rack 17 which is secured to a piston rod 16 extending from an air cylinder 15 suitably supported from the frames 1. A pair of spaced cams 18 and 18 are fixedly mounted on the operation shaft 13 and engaged by rollers 20 on fittings 19 each secured to the underside of the movable holder 10 adjacent the form roller 9. Reciprocation of the rack 17 by the air cylinder 15 causes the pinion 14 to rotate a predetermined angle, thereby angularly displacing the operating shaft 13. Co-operation of the cams 18 with the rollers 20 causes the inking arrangement to swing around the axis of the driving shaft 8 between an applying position where the form roller 9 is brought into contact with the plate 3 on the plate cylinder 2 and a rest position where the form roller 9 is moved away from the plate cylinder 2.

An adjustment bolt 21 is provided for determining an amount of movement of the rack 17 to adjust the angular displacement of the form roller 9 around the axis of the driving shaft 8. Contacting pressure of the form roller 9 on the plate 3 can be adjusted by employing cams 18 having their dimension selected in accordance with a change in the thickness of the plate.

In operation of the printing press according to the invention, it is assumed that both of the inking arrangements 6 in one or both of the printing units P to be operated are in a rest position by moving them away from the plate cylinder 2 under the action of the air cylinders 15. Ink I of desired color is supplied into the ink fountain 12 of one of the inking arrangements in each printing unit and thereafter, the ink fountain roller 7 is rotated through the driving shaft 8 by a suitable drive to transfer the ink from the roller 7 onto the peripheral surface of the form roller 9 in rolling contact relation with the ink fountain roller. Then, the inking arrangement is swung to the applying position relative to the plate cylinder 2 so that the form roller 9 is brought into contact with the plate 3 on the plate cylinder 2 to apply the ink from the form roller 9 onto the plate 3. Thus, sheets of corrugated paperboard S are printed by passing between the rotating inked plate cylinder 2 and pressing cylinder 4.

It will be understood that during the printing operation, the other inking arrangement 6 in each printing unit P is in the rest position. When it is desired to change the color of the ink in compliance with an order change, the ink fountain 12 of the inking arrangement 6 which is in its rest position is filled with ink of different color to transfer the ink from the ink fountain roller 7 onto the form roller 9 in a manner as described above.

When the printing operation of the first sheets is completed, the inking arrangement 6 is brought into its rest position by moving away from the plate cylinder 2 under the action of the cam 18 whereas the other inking arrangement 6 which is ready for application of the ink onto the form roller, is moved toward the applying position so that subsequent sheets of corrugated paperboard can be printed with different color ink. When it is desired to change into color with respect to the inking arrangement 6 in the rest position, the ink present in the ink fountain 12 is allowed to drain back to a suitable supply container and then during the different color printing operation, the ink is washed off the ink fountain and the rollers 7 and 9 with a wash liquid such as water.

It will be noted that some of the previous ink remains on the plate 3 on the plate cylinder 2. In accordance with a common practice, the remaining ink is cleanly wiped off the plate 3 by passing several sheets between the plate cylinder and the pressing cylinder and transferring the ink to the sheets upon completion of the printing and after the inking arrangement in use has been brought into the rest position.

It will be understood that in the printing press according to the invention, one of the printing units P can be employed for single color printing or both can be employed for two-color printing. In either case, a color change can be quickly achieved by switching over between the inking arrangements 6 without any need for stopping the operation of the printing press.

In the printing press in accordance with the invention, means for moving the form roller 9 toward and away from the plate cylinder may be manually or automatically operated linkages or crank mechanisms which are connected to the movable holder 10. Instead of swinging movement, the inking arrangements may be arranged to be slidable forward and backward in a direction of feed of the sheets or upward and downward relative to the plate cylinder. In this case, an ink fountain roller 7 may be releasably connected to a driving shaft 8.

A single switchover mechanism may be employed for two inking arrangements.

In another embodiment of the invention as shown in FIG. 4 of the drawings, a printing unit P comprises two inking arrangements 6 each including an ink fountain 12, an ink fountain roller 7' for applying ink from the ink fountain 12 directly onto a plate cylinder 2 and a scraper 22 in contact with the ink fountain roller 7' for scraping excess ink off the ink fountain roller. The ink arrangements are alternatively employed in accordance with the invention.

I claim:

1. An inking device for a rotary printing press having a plate cylinder and a pressing cylinder cooperating with the plate cylinder, particularly for printing sheets of corrugated paperboard, comprising:

at least two inking arrangements disposed to be movable relative to said plate cylinder, each of said inking arrangements including an ink fountain containing ink and an ink fountain roller partially immersed in the ink; and means for moving one of said inking arrangements into an ink transferring relationship with respect to said plate cylinder and for moving the other inking arrangement out of ink transferring relationship, each of said inking arrangements being moved solely by pivoting about an axis, the pivotal axes of the inking arrangements being parallel to and spaced from each other each of said inking arrangements comprising a form roller carried by the inking arrangement in contact with said ink fountain roller.

2. An inking device according to claim 2, wherein said ink fountain roller of each inking arrangement is rotatable about a supporting shaft, the axis of the supporting shaft forming the axis of the inking arrangement.

3. An inking device according to claim 2, wherein each of said inking arrangements further comprises holders journaled at the ends of said supporting shaft of said ink fountain roller, and a supporting shaft for said form roller journaled in said holders, said ink fountain being fixed to the holders.

4. An inking device according to one of the preceding claims, wherein said means for moving comprises an actuable cam mechanism associated with each of said inking arrangements for effecting swinging movement and for setting the pressure exerted by said form roller against said plate cylinder.

* * * * *